United States Patent [19]

Davison et al.

[11] Patent Number: 4,667,582

[45] Date of Patent: May 26, 1987

[54] DYNAMICALLY BALANCED EXHAUST PIPE CAP

[76] Inventors: Jerome G. Davison, 3361 Stoneybrook, Oklahoma City, Okla. 73120; Gerald E. Hollingshead, 7609 NW. 34th St., Bethany, Okla. 73008

[21] Appl. No.: 862,131

[22] Filed: May 12, 1986

[51] Int. Cl.[4] ..... F23L 17/02

[52] U.S. Cl. ..... 98/59; 98/119

[58] Field of Search ..... 98/59, 122, 71, 73, 98/74, 77, 119

[56] References Cited

U.S. PATENT DOCUMENTS

| | | | |
|---|---|---|---|
| 1,291,184 | 1/1919 | Schulz | 98/59 |
| 1,944,321 | 1/1934 | Huxter | 98/74 X |
| 2,396,876 | 3/1946 | Olsen | 98/73 |
| 2,508,615 | 5/1950 | Lukes | 98/59 |
| 2,983,216 | 5/1961 | Stade et al. | 98/59 |
| 3,363,537 | 1/1968 | De Penning | 98/59 |
| 3,446,010 | 5/1969 | Hopkins | 60/29 |
| 3,523,499 | 8/1970 | Bauerschmidt | 98/59 |
| 3,788,072 | 1/1974 | Burger | 60/324 |

FOREIGN PATENT DOCUMENTS

| | | | |
|---|---|---|---|
| 135217 | 8/1982 | Japan | 98/59 |

*Primary Examiner*—Harold Joyce

*Attorney, Agent, or Firm*—William R. Laney

[57] ABSTRACT

A dynamically balanced protective cap for exhaust pipes, including a tubular element having an angulated bias cut defining a slanted opening at one end thereof. A closure flap assembly is pivotally secured to the tubular element for pivotation about a horizontal axis. The closure flap assembly includes a closure plate configured to lie across the close the slanted opening at one end of the pipe. The flap assembly also has a pair of parallel, trapezoidally shaped balancing plates, each secured along one edge to one edge of the closure plate. The parallel balancing plates are disposed on opposite sides of the tubular element, and each carries a bearing sleeve which receives a stub axel secured to the tubular element. A pair of horizontally spaced, monoplanar wind vanes are secured to aligned edges on the two balancing plates, and each wind vane extends normal to the respective balancing plate to which it is secured.

8 Claims, 4 Drawing Figures

DYNAMICALLY BALANCED EXHAUST PIPE CAP

FIELD OF THE INVENTION

This invention relates to pivotally mounted caps of the type used for closing the atmospheric opening of an exhaust pipe at a time when exhaust gas is not being vented therethrough, and more particularly, to a dynamically balanced closure cap for an exhaust pipe, which cap is geometrically so configured, and has its mass so distributed, that it functions effectively and resists counteractive wind and gravity forces.

BACKGROUND OF THE INVENTION

Brief Description of the Prior Art

Efforts to provide better dynamic balancing in caps for diesel engine exhaust pipes have taken various forms. Thus, in Stade et al U.S. Pat. No. 2,983,216, a rain cap for an engine exhaust pipe is provided, and this cap is of the gravity actuated-type in which the cover member is adapted to fit over the open end of the stack or exhaust pipe, and carries a counterbalancing section or portion which is pivotally supported in a way and at a location such that the cap tends, by reason of the shift of the center of gravity, to reseat or close when the exhaust gases are not acting on the cap to open it. This cap is susceptible, however, to opening under wind pressure, or the pressure of air developed as the tractor upon which the cap is mounted is carried over the road on a transport vehicle if the cap is faced in an improper direction. In the full closed position, the cap extends horizontally across the upper end of the exhaust pipe, and it is therefore necessary for the cap to open through almost 90° in order for it to achieve a fully open position. This requires the exertion of a greater opening force from the exhaust gases which are being vented through the exhaust pipe, and can result in an undesirably high level of back pressure being exerted on the exhaust gases attempting to pass through the exhaust pipe.

Bauerschmidt U.S. Pat. No. 3,523,499 discloses a weather cap construction for an exhaust pipe. The weather cap is held on the exhaust pipe by a collar which is closed about the exhaust pipe by a suitable clamping bolt. In the Bauerschmidt cap, the pivoted closure element is supported for pivotation about a pivotal axis which is displaced laterally from the vertical axis of the exhaust pipe by a substantial distance, and when the cap is in its elevated, fully opened position, it exerts essentially no back pressure on the gases passing from the exhaust pipe. It must, however, open through an angle which is almost 90°, and therefore in the initial phase of the opening arc, an undesirable amount of back pressure may be exerted on the exhaust gases. A positive stop is provided to limit how far the crank upon which the closed cap is carried will open in its full open position, and this positive stop is in a position such the center of gravity still remains inside the pivotal axis. The crank arm will therefore fall, under the influence of gravity, to a closed position, once the exhaust gases cease to be vented through the exhaust pipe.

In De Penning U.S. Pat. No. 3,363,537, a tractor exhaust pipe cover is illustrated and described. The cover depicted includes a cap which pivots into, and away from, a horizontal plane representing the position of closure of the cap. The cap carries reflector devices in the form of a pair of platelike reflectors mounted on the opposite side of the pivotal axis of the cap structure from the cap plate proper. These reflectors afford some weight which assists the cap in opening in response to the force exerted by the upwardly moving exhaust gases.

Other types of exhaust cap structures are those which are depicted and described in Taylor U.S. Pat. No. 2,494,016; Burger U.S. Pat. No. 3,788,072 and Lukes U.S. Pat. No. 2,508,615.

BRIEF DESCRIPTION OF THE PRESENT INVENTION

The present invention is an improved, dynamically balanced protective cap which is useful on the exhaust pipes of diesel engines for the purpose of preventing dust, debris and rain from entering the exhaust pipe, and thereby fouling the engine or preventing smooth running of the engine. The protective cap also is constructed so that the engine is protected from wind force acting deleteriously upon any turbocharger that may be a part of the engine, and be accesible to the down draft of wind entering the exhaust pipe and proceeding downwardly toward the engine.

The protective cap of the invention includes a tubular element by which the cap assembly in its entirety is secured to a pipe which projects in a vertical direction from a diesel engine for the purpose of venting engine exhaust gases to the atmosphere. A closure flap assembly is pivotally secured to the tubular element for pivotation about a horizontal axis in undergoing opening and closing movement with respect to the exhaust pipe upon which the protective cap is mounted. The tubular element is cut through at an angle or on a bias, so that the opening at the upper end of the exhaust pipe is angulated with respect to the vertical. Because of this, a closure plate which forms a part of the closure flap assembly can lie at an angle against the upper edge of the exhaust pipe which surrounds the discharge opening, and this closure plate need only open through an angle of about 40° to achieve its fully open position. This aids in obviating the development of undesirable back pressure in the pipe and at the exhaust port of the engine at a time when the engine is running and exhaust gases are being vented through the pipe past the closure plate.

The closure plate has a pair of parallel balancing plates secured to the opposite sides of the closure plate and located on opposite sides of the tubular element. These balancing plates preferably lie in spaced parallel planes. The parallel balancing plates function to aid in distributing the weight and in translating the center of gravity of the moveable closure flap assembly in such way that the closure flap can be easily opened and easily closed when the exhaust gases terminate their flow through the exhaust pipe. Each of the parallel balancing plates carries a bearing sleeve which receives a stub axle, or other pivotal support element, which is secured to the tubular element. A pair of horizontally spaced, monoplanar wind vanes are secured to aligned edges on the two balancing plates, and each preferably extends normal to the respective balancing plate, with the two wind vanes preferably located in coplanar alignment with each other.

The dynamically balanced protective cap of the invention, as thus constructed, avoids chattering caused by rapidly opening and closing in a cylical motion at a time when the engine is running, and exhaust gases are being vented through an exhaust pipe carrying the cap.

Another important object of the invention which is achieved by the structure utilized is the obviation of opening of the pivoted closure flap assembly under the force developed by an artifical or natural air movement developed either when the engine upon which the protective cap is mounted is standing stationary, or is being towed by means of an over-the-road vehicle.

An additional object of the invention is to provide a dynamically balanced protective cap for mounting on an exhaust pipe of a diesel engine, which cap requires relatively little movement to move from its full closure position to a fully opened position, and requires relatively little exhaust gas pressure in order to achieve this opening, thereby reducing the propensity of such caps to cause an undesirable back pressure acting downwardly through the exhaust pipe to the location of the exhaust ports of the engine.

A further object of the invention is to provide a dynamically balanced protective cap for the exhaust pipe of a diesel engine, which cap is characterized in having relatively few moving parts, and in having a relatively long and trouble free operating life.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

DETAILED DESCRIPTION OF A PREFERRED EMBODIMENT OF THE INVENTION

Figure 1:
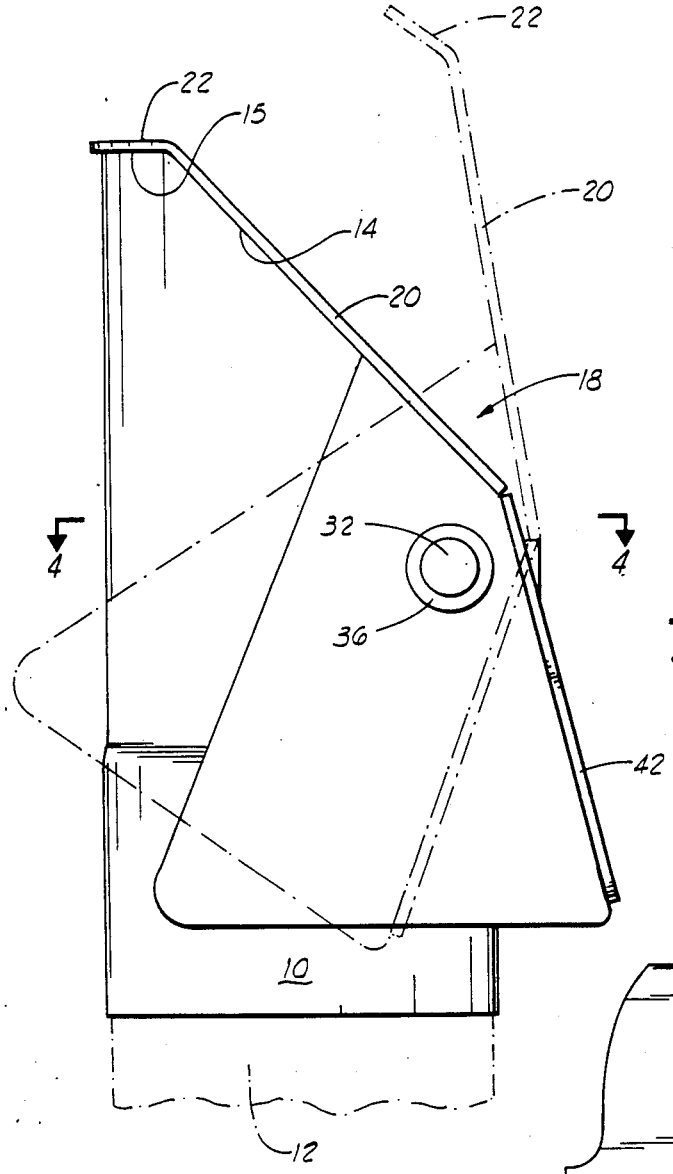
FIG. 1 is a side elevation view of a dynamically balanced exhaust pipe cap of the invention as it appears when mounted atop an exhaust pipe, here illustrated in phantom lines. The open position of the exhaust pipe cap is illustrated by the use of a dashed line.

The dynamically balanced exhaust pipe cap of the invention includes a tubular element which, in the illustrated embodiment, is cylindrical in configuration and is denominated generally by reference numeral 10. The tubular element 10 is open at its lower end so that it can be slipped over the top of an exhaust pipe 12. The exhaust pipe 12 can typically be any of those types used to vent exhaust gases from a diesel engine. The tubular element 10 is cut through at its upper end along a plane which extends at an angle to the longitudinal axis of the tubular element, and thus terminates in an angulated bias cut which defines an oval-shaped opening in the upper end of the tubular element. A portion of the upper edge of the tubular element 10 which defines and surrounds the oval, angulated opening is identified by reference number 14, which edge portion lies in the described plane extending at an acute angle to the longitudinal axis of the tubular element. The edge 14 intersects a second portion 15 of the upper edge, which second portion lies in a horizontal plane and is coextensive with a chord of a circle.

Figure 2:
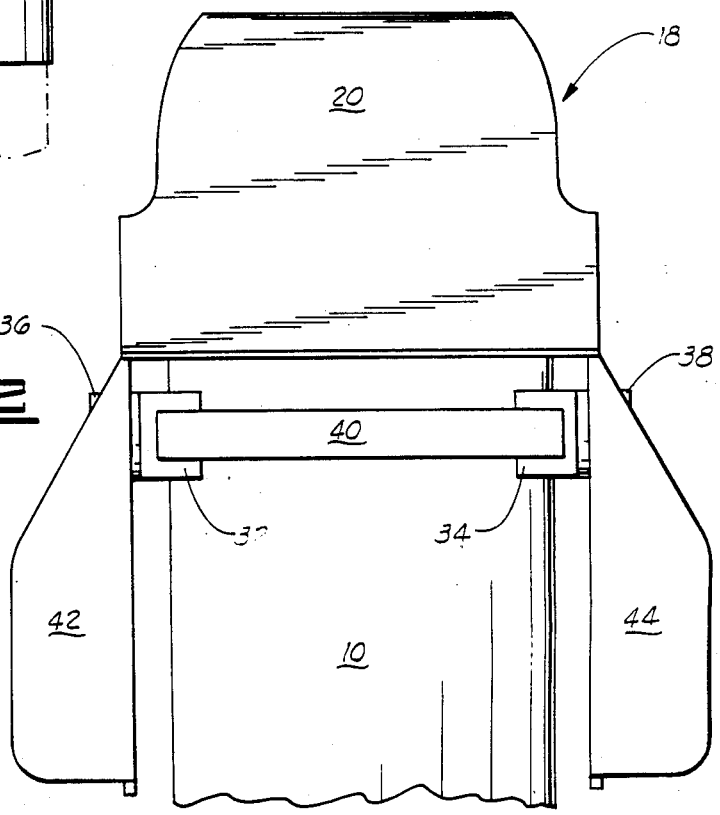
FIG. 2 is a view in front elevation of the dynamically balanced exhaust pipe cap of the invention, as the cap appears when viewed after having been rotated to the left (clockwise) from the position illustrated in FIG. 1.
Figure 3:
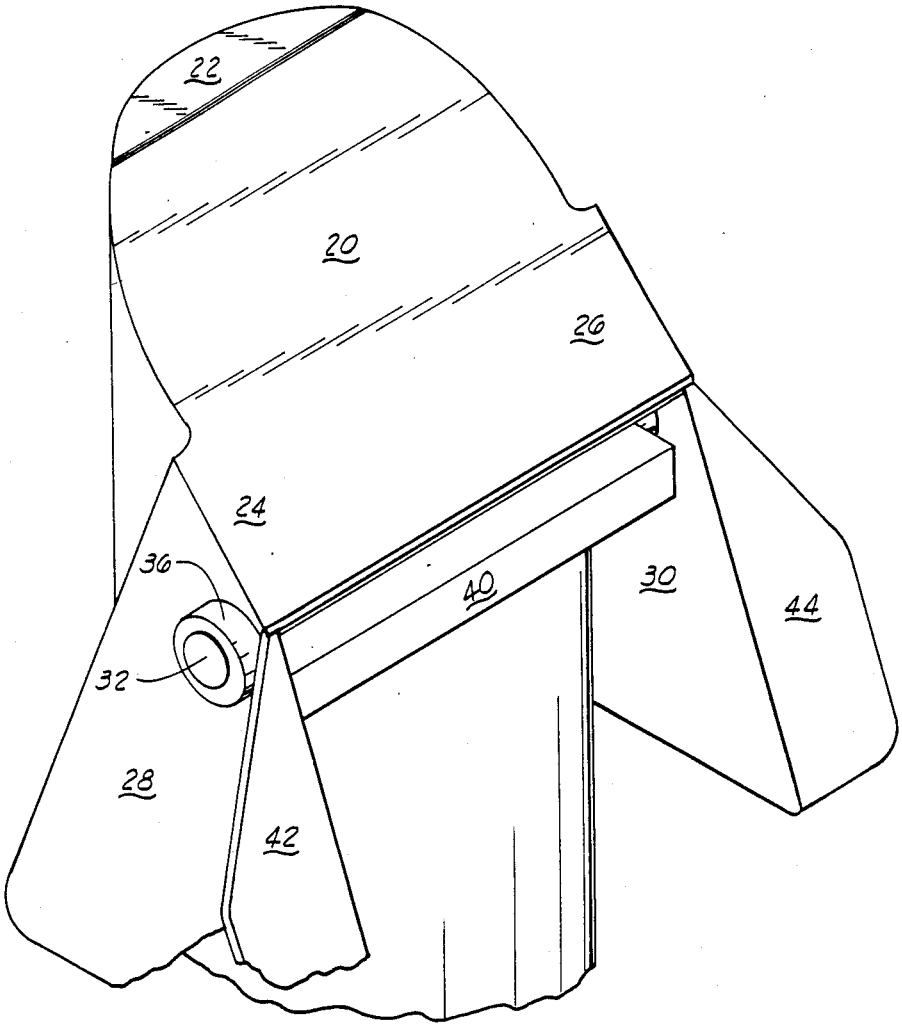
FIG. 3 is a perspective view of the dynamically balanced exhaust pipe cap depicted in FIG. 1.

The dynamically balanced protective cap of the invention further includes a closure flap assembly designated generally by reference numeral 18. The closure flap assembly 18 includes a closure plate 20 which is most clearly illustrated in FIG. 3. The closure plate 20 has a horizontally extending the lip 22 forming a part of the cover plate, and located and configured to lie against the second upper edge portion 15 of the tubular element 10 as shown in FIGS. 2 and 3. The closure plate 20 is also characterized in having a pair of opposed lateral flanges 24 and 26 disposed at the opposite side of the cover plate from the horizontally extending lip 22.

The lateral flanges 24 and 26 function as points of attachment to the cover plate of a pair of downwardly extending trapezoidally shaped balancing plates 28 and 30. The balancing plates 28 and 30 extend in spaced parallel planes and are disposed on opposite sides of the tubular element 10. Each balancing plate 28 and 30 is joined at one edge to the edge of a respective one of the lateral flanges 24 and 26. Further, the balancing plates 28 and 30 lie in planes which extend normal to the plane of the principle portion of the closure plate 20.

Figure 4:
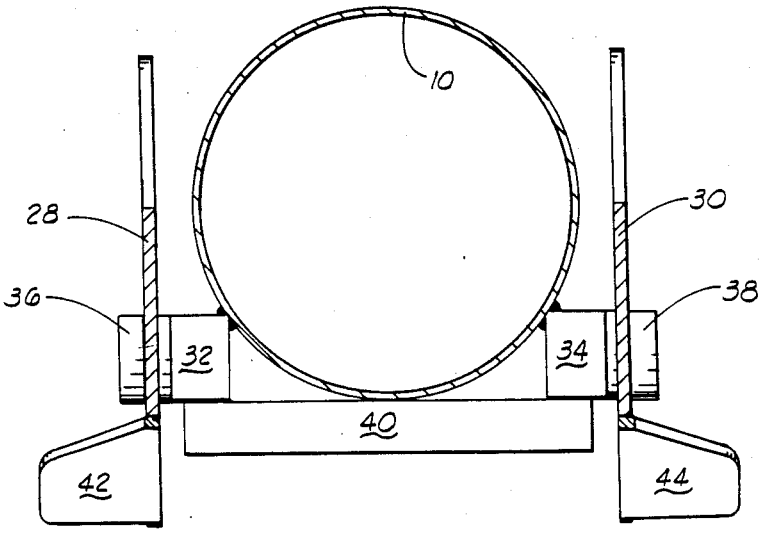
FIG. 4 is a sectional view taken along line 4—4 of FIG. 1.

In order to permit the closure flap assembly 18 to be pivotally mounted on the tubular element 10, a pair of stub axles or shafts 32 and 34 are welded to the outer periphery of the tubular element 10, as shown in FIG. 4, and have reduced diameter portions which project into sleeves 36 and 38 secured through the balancing plate 28 and 30 in the manner best illustrated in FIGS. 2 and 4.

In order to provide a stop to limit the pivotal movement of the closure flap assembly 18 when it undergoes movement to open the exhaust pipe upon which the dynamically balanced cap is mounted, a stop bar 40 is welded or otherwise suitably secured across the back side of the tubular element 10 along a line tangent to the tubular element. The stop bar 40 has its opposite ends further mechanically supported by securement to the stub axles or shafts 32 and 34.

The closure flap assembly 18 further includes a pair of spaced, coplanar wind vanes 42 and 44 which are secured to the respective aligned rear edges of the two balancing plates 28 and 30 as shown in FIGS. 3 and 4.

OPERATION OF THE INVENTION

In using the dynamically balanced exhaust pipe cap of the invention, the cap is first mounted on a tubular exhaust pipe by telescoping the tubular element 10, into or around the exhaust pipe 12 in the manner illustrated in FIG. 2 of the drawings. The tubular element 10 can be secured by press fit, or by a strap or band used in a fashion similar to a hose clamp to securely engage the tubular element with the exhaust pipe.

After the cap is mounted on the exhaust pipe in the manner described, it is ready to perform its function. The function of the exhaust cap is to prevent the entry into the exhaust pipe of dust, debris or rain so as to cause an undesirable accumulation of these contaminants at the bottom of the exhaust pipe and in or adjacent the exhaust ports of the engine, thus impairing engine operation. This influx of dust, rain or other contaminants to the interior of the exhaust pipe is particularly deleterious in its effect upon turbochargers where such are used as a part of the diesel power plant.

The exhaust cap of the invention is suitable for use on substantially any exhaust pipe used on diesel generator devices or on diesel power units.

Another important consideration and desideratum in the utilization and effective functioning of exhaust caps employed on diesel engine exhaust pipes is that the caps open freely and sufficiently fully at a time when the engine is operating and exhaust gases are being vented to the atmosphere that either no back pressure, or an acceptably low amount of back pressure, is developed within the exhaust pipe as a result of the impediment to flow of exhaust gases afforded by the exhaust cap.

It is also important in the case of tractors having turbochargers that the cap not blow open at a time when the inactive tractor is being hauled over the road at a high speed on a flat bed truck or the like. If the cap blows open during this time, a sufficient amount of air pressure can be developed downwardly in the exhaust pipe by the wind action to spin the turbocharger. If this occurs when the engine is not running, it can seriously damage the turbocharger. This danger is especially a concern at a time when the truck carrying the tractor having a turbocharged engine is proceeding at a high rate of speed, and directly into a wind which is blowing in an opposite direction with a substantial force. In some practices used for avoiding this problem in the past, provision has been made for pinning the pivotally-mounted exhaust pipe cap closed at a time when the engine is not operating. The failing of this method has been that personnel charged with the care of the engine, or with the transport of the tractor or diesel generator which is involved, have not been careful to pin the cap in its closed position before transport or wind force exposure.

In the case of the dynamically balanced protective cap of the present invention, once the tubular element 10 has been mounted on the exhaust pipe 12, the cap is oriented so that it faces toward the forward end of the tractor or engine as it faces left in FIG. 1. The tractor or engine carrying the exhaust pipe will normally be supported on a transporting truck so that the forward end of the vehicle upon which it is carried will be toward the left in FIG. 1, and when the flap assembly 18 pivots to an open position, as shown in dashed lines of FIG. 1, the flap assembly will be pivoting away from the forward end of a truck or other vehicle on which the engine or tractor carrying the engine is mounted.

Under this condition, the wind caused by movement of the carrying vehicle impinges against the wind vanes 42 and 44 in a direction such that a force is applied to the closure flap assembly 18 which makes it remain seated in its closed position. This direction of wind flow at this time is shown by the arrow, W, in FIG. 1. If, on the other hand, the engine having the exhaust pipe to which the protective cap is mounted is turned in the opposite direction on the bed of a carrying truck, then the wind force which impinges upon the closure flap assembly 18 acts in the opposite direction from the direction of the action indicated by the arrow "W" in FIG. 1. The wind in this case will exert closing force on the large area of the closure plate 20 which is exposed thereto. This large area is illustrated in FIG. 2 of the drawings. The surface area here exposed to impingement by the wind is greater than that exposed surface area which is represented by the combined areas of the wind vanes 42 and 44. The flap assembly 18 will therefore also remain closed at this time.

When a diesel engine having an exhaust pipe 12 is in operation, the geometry of the protective cap is such that the cap swings easily about the pivotal axis which is projected along the axis of the stub axles 32 and 34, and moves to the open position illustrated in dashed lines in FIG. 1. The protective cap of the present invention is constructed so that the closure plate 20 and horizontally extending lip 22 need move only a short distance from the "at rest" position shown in full lines of FIG. 1 to the fully opened position shown therein by the dash lines. Preferably, pivotation through an angle of about 40° is all that is required to achieve the fully open position. It thus does not require a great deal of exhaust gas pressure to raise the closure flap assembly to this extent, and yet to thereby achieve full opening of the exhaust pipe 12 to the atmosphere. There is thus very little back pressure developed in the course of moving the closure flap assembly 18 to the fully opened position. Further, with the closure flap assembly 18 in this position, the balance and center of gravity location of the entire structure is such that there is little inclination of the closure flap assembly to chatter, or to rapidly open and close so that the assembly becomes worn out in a short period of time.

Finally, the stub axles 32 and 34, and the sleeves 36 and 38 in which they are received, form sturdy bearing structures of high mechanical strength. Preferably, the stub axles 32 and 34 have a diameter of about 9/16 inch. This construction, together with the dynamic balancing of the flap assembly which prevents it from chattering, or rapidly opening and closing, greatly extend the service life of the protective cap of the present invention, and prevent it from becoming ineffective after a short period of operation of the diesel engine upon which the protective cap is utilized.

Although a preferred embodiment has been herein described in order to afford those having ordinary skill in the art a clear understanding of the operating principals on which the invention is based, it will be understood that various changes and innovations can be effected in the described structure without departure from the basic principles which underlie the invention. Changes and innovations of this type are therefore deemed to be circumscribed by the spirit and scope of the invention, except as the same may be necessarily limited by the appended claims or reasonable equivalents thereof.

What is claimed is:

1. A dynamically balanced protective cap for internal combustion engines comprising:

a tubular element having an angulated bias cut defining a slanted opening at one end of the tubular element and lying in a plane extending at an acute angle to the tubular element axis, said tubular element having a horizontal cut at the upper edge portion of the slanted opening; and a closure flap assembly pivotally secured to said tubular element, and including:

a closure plate having a major closure portion of relatively large surface area extending in said plane across, and closing, said opening at one end of said tubular element when in a closing position, and including a lip of relatively smaller surface area extending in a second plane which projects normal to the axis of the tubular element;

a pair of horizontally spaced balancing plates disposed on opposite sides of said tubular element and each having one edge secured to one side edge of said closure plate, said balancing plates projecting from said closure plate away from said opening at one end of said tubular element and alongside said tubular element;

a pair of spaced wind vanes each secured to one of said balancing plates and each positioned to extend into the path of air flow normal to said tubular element, and located on opposite sides of said tubular element and extending in a direction away from said tubular element; and means pivotally supporting the closure flap assembly on said tubular element for pivotation about an axis extending through said balancing plates and lying in a plane extending normal to the axis of said tubular element.

2. A dynamically balanced protective cap for internal combustion engines described in claim 1 wherein said tubular element is cylindrical.

3. A dynamically balanced protective cap for internal combustion engines described in claim 2 wherein said pivotal axis extends parallel to a tangent to said cylindrical tubular element.

4. A dynamically balanced protective cap for internal combustion engines described in claim 1 wherein said balancing plates extend parallel to each other.

5. A dynamically balanced protective cap for internal combustion engines described in claim 4 wherein major portions of each of said balancing plates lie on the opposite side of said pivotal axis from said wind vanes.

6. A dynamically balanced protective cap for internal combustion engines described in claim 1 wherein said balancing plates lie in parallel, horizontally spaced planes, and said spaced wind vanes are in coplanar alignment with each other and extend normal to said balancing plates.

7. A dynamically balanced protective cap for internal combustion engines described in claim 6 wherein major portions of each of said balancing plates lie on the opposite side of said pivotal axis from said wind vanes.

8. A dynamically balanced protective cap for internal combustion engines described in claim 7 wherein said pivotal axis extends parallel to a tangent to said cylindrical tubular element.

* * * * *